US007020932B2

(12) United States Patent
Breuer et al.

(10) Patent No.: US 7,020,932 B2
(45) Date of Patent: Apr. 4, 2006

(54) APPARATUS AT A CARDING MACHINE, WHEREIN AT LEAST ONE STATIONARY CARDING SEGMENT IS ASSOCIATED WITH A ROLLER

(75) Inventors: Achim Breuer, Aachen (DE); Alexander Hohn, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 10/825,364

(22) Filed: Apr. 16, 2004

(65) Prior Publication Data

US 2004/0226143 A1 Nov. 18, 2004

(30) Foreign Application Priority Data

Apr. 26, 2003 (DE) ..... 103 18 968

(51) Int. Cl.
*D01G 15/02* (2006.01)

(52) U.S. Cl. ..... 19/104

(58) Field of Classification Search ..... 19/98, 19/104, 105, 110, 113, 114
See application file for complete search history.

(56) References Cited

U.S. PATENT DOCUMENTS 3,737,953 A * 6/1973 Bechtel, Jr. ..... 19/113
4,996,745 A * 3/1991 Sutcliffe ..... 19/104
5,031,278 A * 7/1991 Demuth et al. ..... 19/98
6,189,184 B1 * 2/2001 Pferdmenges et al. ..... 19/104
2002/0157216 A1 10/2002 Graf

FOREIGN PATENT DOCUMENTS

| | | |
|---|---|---|
| CH | 681 546 A5 | 4/1993 |
| DE | 198 09 330 A1 | 9/1999 |
| EP | 0 195 756 A3 | 9/1986 |
| EP | 0 431 482 A1 | 6/1991 |
| GB | 2 340 509 A | 2/2000 |
| GB | 2 372 045 A | 8/2002 |
| WO | WO 00/05441 A1 | 2/2000 |

* cited by examiner

*Primary Examiner*—Gary L. Welch
(74) *Attorney, Agent, or Firm*—Venable LLP; Robert Kinberg

(57) ABSTRACT

In an apparatus at a carding machine, wherein at least one stationary carding segment comprising a carrier together with at least two carding elements is associated with a roller, for example a cylinder, which carding elements are arranged behind one another in the direction of rotation of the roller, the clothings of the carding elements and the roller clothing are located opposite one another.

In order, by means that are simple in terms of construction and installation, to make possible individual setting of the carding intensity and a reduction in wear on the clothings of the carding elements, the carding surface of at least one carding element forms an angle with a respective tangent at the clothing of the roller 4 and the carding elements are arranged in stationary manner with respect to the roller.

29 Claims, 7 Drawing Sheets

APPARATUS AT A CARDING MACHINE, WHEREIN AT LEAST ONE STATIONARY CARDING SEGMENT IS ASSOCIATED WITH A ROLLER

CROSS REFERENCE TO RELATED APPLICATION

This application claims priority from German Patent Application No. 103 18 968.8 dated 26 Apr. 2003, the disclosure of which is incorporated herein by reference.

BACKGROUND OF THE INVENTION

The invention relates to an apparatus at a carding machine, wherein at least one stationary carding segment comprising a carrier together with at least one carding elements is associated with a roller, for example a cylinder.

In a known apparatus at least two carding elements are arranged behind one another in the direction of rotation of the roller, and the clothings of the carding elements and the roller clothing are located opposite one another. According to EP 0 431 482, a plurality of stationary carding segments, each comprising three fixed carding elements, are associated with the cylinder of the carding machine, each of them being fastened by means of end parts to the associated side frame of the carding machine. The mounting surfaces for the three fixed carding elements on a carrier are so matched to the curvature of the cylinder that, when the carding segment has been optimally set, the width of each carding element extends perpendicular to a respective radius of the cylinder. The carding surfaces of the carding elements are accordingly, in each case, oriented parallel to a corresponding tangent at the clothing of the cylinder. Re-setting can be so performed, for example with the aid of a suitable gauge, that the clothing of one of the carding elements has a desired spacing from the clothing of the cylinder. However, in all probability, the clothings of the other two carding elements will not then have the desired spacing from the cylinder clothing. The desired setting is achieved by means of a pivoting movement of the carding segment about a predetermined axis. During that pivoting movement, all three inter-connected carding elements are displaced until the desired setting has been achieved, at which setting the width of all the carding elements extends perpendicular to a respective radius of the cylinder. The complexity of the construction for pivoting and fixing the carding segment is disadvantageous. It is also disadvantageous that orientation of the carding elements parallel to a respective tangent at the roller results in increased fibre damage and nep formation. Finally, the clothings of the carding elements are subject to considerable wear in operation.

It is an aim of the invention to provide an apparatus of the kind described at the beginning which avoids or mitigates the mentioned disadvantages and which especially is simple in terms of construction and installation, enables individual setting of the carding intensity and makes possible a reduction in wear on the clothings of the carding elements.

SUMMARY OF THE INVENTION

The invention provides a carding machine having:

a roller which has a direction of rotation;

a carding segment opposing said roller and comprising a carrier and first and second carding elements arranged one behind the other in the direction of rotation of the roller;

wherein:

said first carding element has a first carding surface;

said second carding element has a second carding surface; and at least one of said carding surfaces is inclined with respect to a tangent at the opposed roller surface.

The measures according to the invention make it possible for the angle between the clothing surface of each carding element and the cylinder clothing—the so-called "offset angle"—to be selected individually. It is especially advantageous that, as a result of specifically or individually orienting the clothing surfaces of the carding elements in relation to one another, the ratio of fibre damage to nep formation is very considerably improved. In addition, the lasting technical improvement is achieved in especially simple manner in terms of construction. As a result of the stationary arrangement of the carding elements there is no need for additional devices for pivoting the carding segments. According to a further advantage, the wear on the clothings of the carding elements is considerably reduced as a result of the individual inclination of the carding surfaces.

The carding elements may be non-movable. The carding elements may be movable.

The term "stationary" is used herein in relation to one or more carding elements as meaning that the carding element or elements maintain their position as such in the carrier and also with respect to the roller. The term "movable" is used herein in relation to one or more carding elements as meaning that the orientation of the carding element or elements relative to the carrier and/or roller can be changed, for example, by rotation of the element or elements. The carding elements are advantageously rotatable about an axis parallel to the roller. Advantageously, the angles are the same. Advantageously, the angles are not the same. The angle may be acute. The angle may be obtuse. One of said first and second elements may advantageously be inclined at an acute angle and the other at an obtuse angle, said acute and obtuse angles advantageously being complementary. Advantageously, the carding surface of at least one carding element forms an angle with a respective radius of the roller. Advantageously, the roller is the cylinder of the carding machine. Advantageously, the carding elements are arranged to be rotatable about an axis of rotation parallel to the roller axis, the spacing between the clothings of the carding elements and the roller clothing being adjustable. Advantageously, the carding elements are arranged to be individually rotatable in the carrier. Advantageously, the carding elements are arranged to be rotatable in relation to a fastening surface. Advantageously, the axis of rotation is, in each case, arranged in the middle of a carding element. Advantageously, the axis of rotation is, in each case, associated with the end region of a carding element. Advantageously, an adjusting device for the rotation is provided. The adjusting device preferably has at least one adjusting screw or the like. Advantageously, a rotary connection is associated with each carding element. Advantageously, the carrier is attached at both ends to a stationary support by means of a fastening element, for example a fastening bolt. Advantageously, the carding elements are arranged to be detectable. Advantageously, at least one apparatus is arranged in the preliminary carding zone between a licker-in and the rear card-top-deflecting roller of the revolving card top. Advantageously, at least one apparatus is arranged in the after-carding zone between a doffer and the front card-top-deflecting roller of the revolving card top. Advantageously, at least one apparatus is arrange din the underneath carding zone between the doffer and the licker-in. Advantageously, only stationary card top elements are associated with the cylinder of the carding machine, and a plurality of apparatuses are provided at the cylinder. Advantageously, a carding segment has two carding elements. Advantageously, the angle can be changed in operation and out of operation of the carding machine. Advantageously, the angle for two carding elements can be changed simultaneously, the angular position settings of the carding elements being coupled to one another. Advantageously, when the angles are changed, the transmission ratio (angular change) of each carding element is different. Advantageously, a central adjusting device is provided for changing the angles of all the carding elements. Advantageously, the adjusting device comprises a drive motor, for example a step motor. Advantageously, the angles are arranged to be adjusted in stepped manner from carding segment to carding segment, for example to be changed centrally by 0.5°. Advantageously, the spacing between the carding segment and cylinder remains constant. Advantageously, the angular position between the licker-in and the rear card-top-deflecting roller and the angular position between the doffer and the front card-top-deflecting roller are different. Advantageously, the adjusting device, for example the step motor, is connected to an electronic control and regulation device.

Advantageously, the carrier is an extruded profile, for example aluminium. Advantageously, a deflecting element or the like, for example a spoiler or similar, is provided at the entry region of the carding segment, seen in the direction of rotation of the cylinder. Advantageously, the deflecting element or the like is arranged upstream of the carding segment. Advantageously, the deflecting element or the like shields the tips of the carding elements.

Advantageously, an angle display, for example an angle scale or the like, is provided. Advantageously, the angle is arranged to be changed starting from a tangential position of the carding surface of the carding element (zero point). Advantageously, in a carding segment, the carding nip becomes smaller at the first carding element and larger at the second carding element, seen in the direction of rotation of the cylinder. Advantageously, each carding element is arranged to be rotated in the carrier with two degrees of freedom. Advantageously, the rotation of each carding element takes place about a stationary axis (longitudinal axis) in the carrier. Advantageously, the spacings at the narrowest locations of the carding nips are the same or substantially the same.

The invention also provides an apparatus at a carding machine, wherein at least one stationary carding segment comprising a carrier and one carding element is associated with a roller, for example a cylinder, and wherein the clothing of the carding element and the roller clothing are located opposite one another, in which the carding surface of the carding element forms an angle to a tangent at the clothing of the roller, and the carding element is arranged in stationary manner with respect to the roller. Advantageously, a plurality of carding segments are arranged behind one another in the work direction. Advantageously, the carding element is stationary and non-movable. Advantageously, the carding element is stationary and rotatable about its longitudinal axis.

The invention also provides an apparatus at a carding machine, wherein at least one stationary carding segment comprising a carrier together with at least two carding elements is associated with a roller, for example a cylinder, which carding elements are arranged behind one another in the direction of rotation of the roller, and wherein the clothings of the carding elements and the roller clothing are located opposite one another, characterised in that the carding surface of at least one carding element forms an angle with a respective tangent at the clothing of the roller, and the carding elements are arranged in stationary manner with respect to the roller.

DESCRIPTION OF THE PREFERRED EMBODIMENTS

Figure 1:
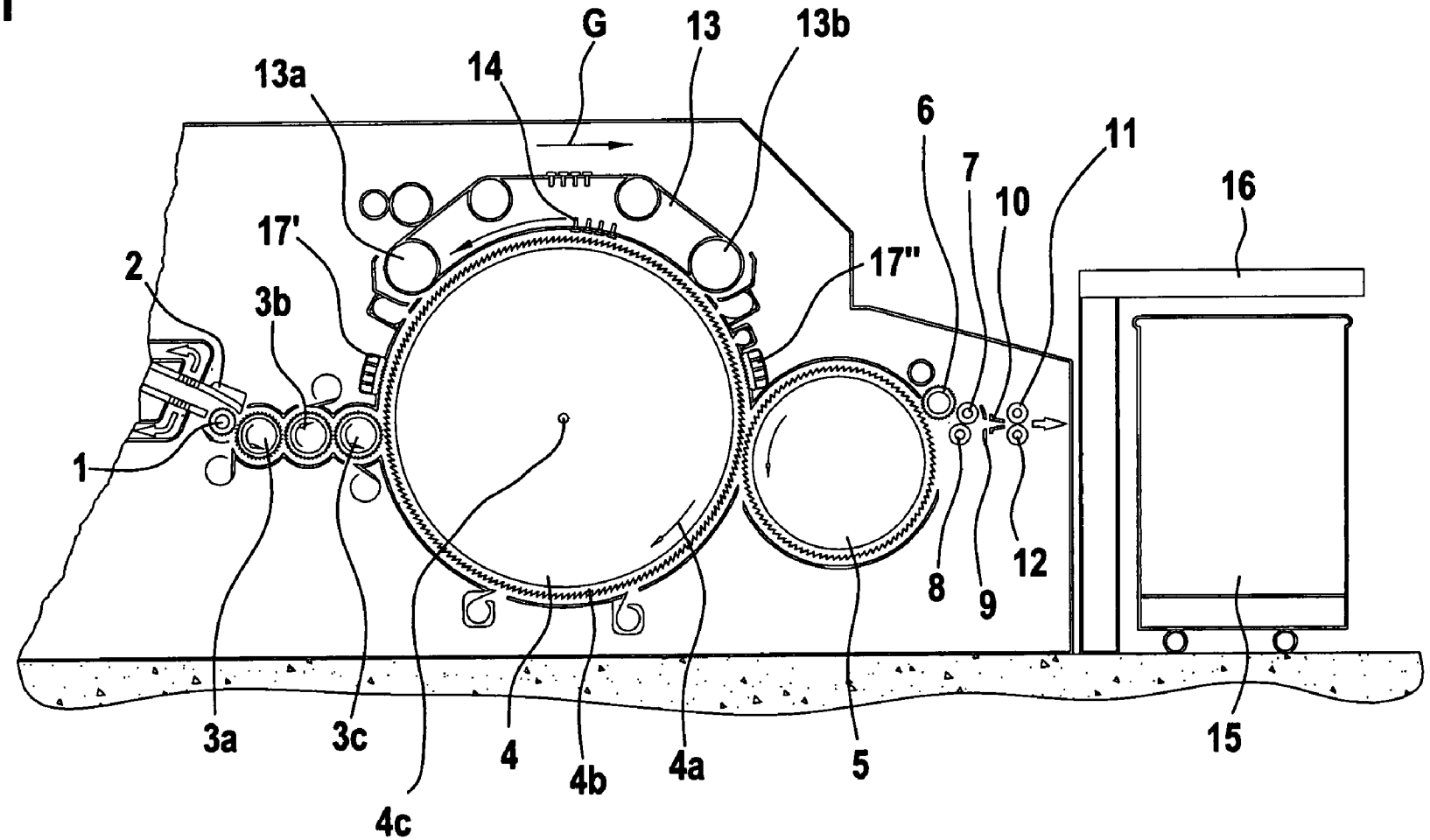
FIG. 1 shows, in a diagrammatic side view, a carding machine according to the invention.

With reference to FIG. 1 a carding machine, for example a DK 903 high-performance carding machine made by Trutzschler GmbH & Co. KG of Mönchengladbach, Germany, has a feed roller 1, feed table 2, lickers-in 3*a*, 3*b*, 3*c*, cylinder 4, doffer 5, stripper roller 6, nip rollers 7, 8, web-guiding element 9, web funnel 10, draw-off rollers 11, 12, revolving card top 13 having card-top-deflecting rollers 13*a*, 13*b* and card top bars 14, can 15, can coiler 16 and fixed carding segments 17', 17" according to the invention each having carding elements. Reference numeral 4*a* denotes the direction of rotation of the cylinder 4, reference numeral 4*b* denotes the clothing of the cylinder 4, and reference numeral 4*c* denotes the central axis of the cylinder 4. Reference letter G denotes the work direction.

Figure 2:
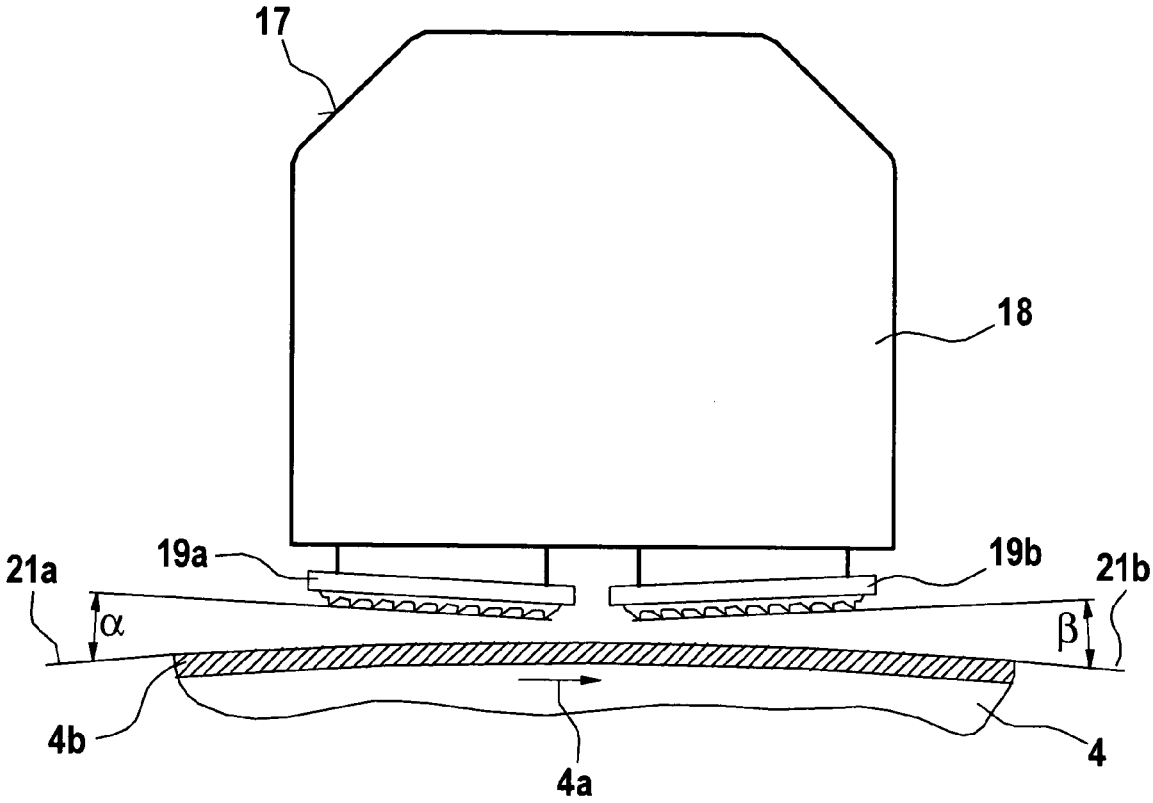
FIG. 2 shows, in a side view and in section, a fixed carding segment having two non-movable carding elements, the carding surfaces of which are arranged at an angle to the cylinder clothing.
Figure 2A:
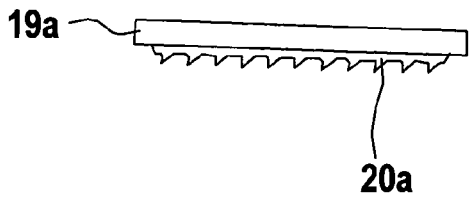
FIG. 2*a* shows a carding element having a sawtooth clothing.
Figure 3A:
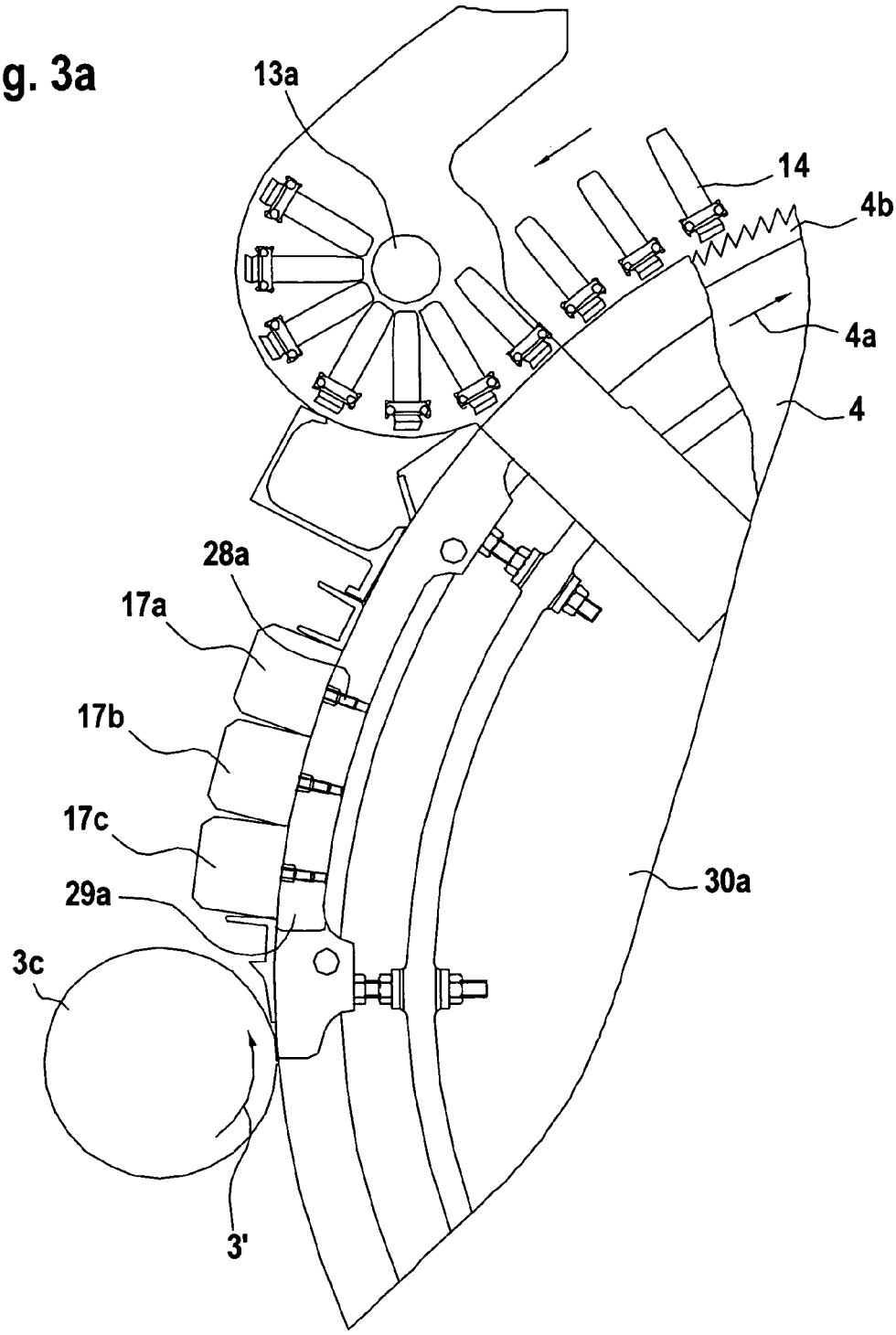
FIG. 3*a* shows three fixed carding segments according to the invention in the preliminary carding zone of a revolving card top carding machine.
Figure 3B:
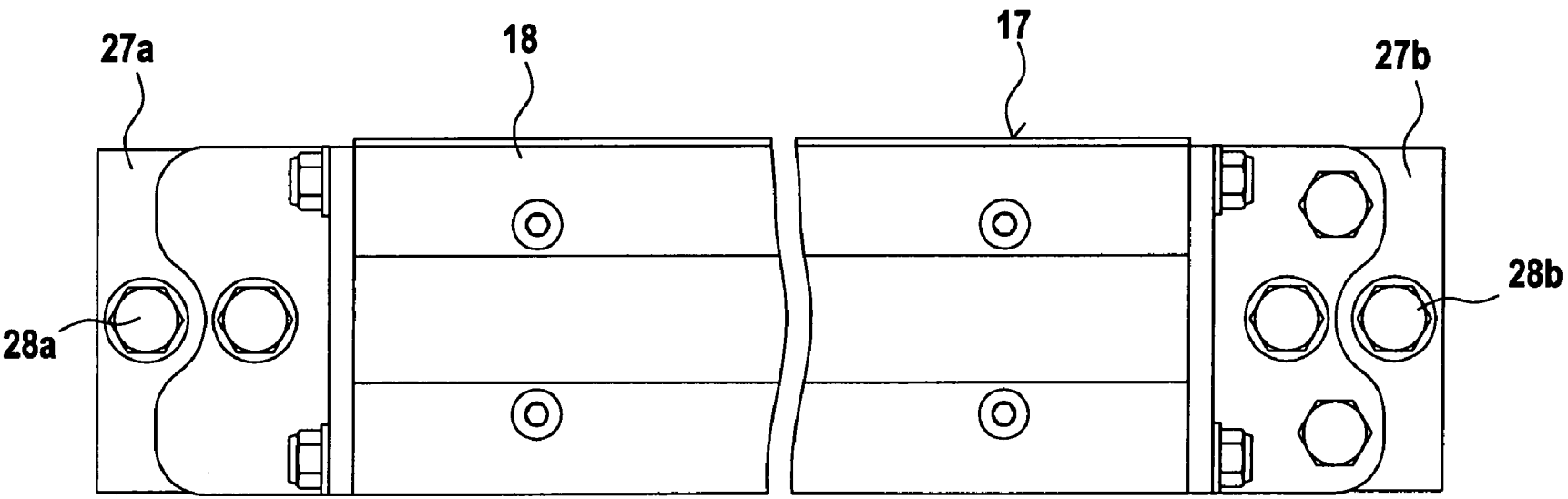
FIG. 3*b* is a top view of the fastening at both ends of a carding segment.

The carding segment 17 according to FIG. 2 consists of a carrier 18 and two carding elements 19*a*, 19*b*, which are arranged behind one another in the direction of rotation (arrow 4*a*) of the cylinder 4, the clothings 20*a*, 20*b* (FIG. 2*a*) of the carding elements 19*a* and 19*b*, respectively, lying opposite the clothing 4*b* of the cylinder 4. The carding elements 19*a*, 19*b* are stationary and arranged in movable manner. The carding surfaces of the sawtooth-shaped clothings 20*a*, 20*b* (see FIG. 2*a*) of the carding elements 19*a*, 19*b* form an acute angle α and β, respectively, with a respective tangent 21*a* and 21*b*, respectively, at the clothing 4*b* of the cylinder 4. It will be appreciated that reference to a respective tangent is to a tangent at a location on the roller corresponding to the nip defined between the respective carding element and the roller. In the embodiment of FIG. 3*a*, fixed carding segments 17*a*, 17*b* and 17*c*, at least one and advantageously each of which is as described with reference to FIG. 2, are arranged in the preliminary carding zone between the licker-in 3*c* and the rear card-top-deflecting roller 13*a* of the revolving card top 13. As FIG. 3*b* shows, the carrier 18 of each carding segment 17 is fastened to two fastening plates 27*a*, 27*b*. The fastening plates 27*a*, 27*b* are attached, by means of bolts 28*a*, 28*b*, to extension bends 29*a* and 29*b*, respectively (FIG. 3*a* shows only the extension bend 29*a* on one side of the carding machine), which are in turn fastened to the card plates 30*a* and 30*b*, respectively, on each side of the carding machine (only 30*a* is shown in FIG. 3*a*).

Figure 4:
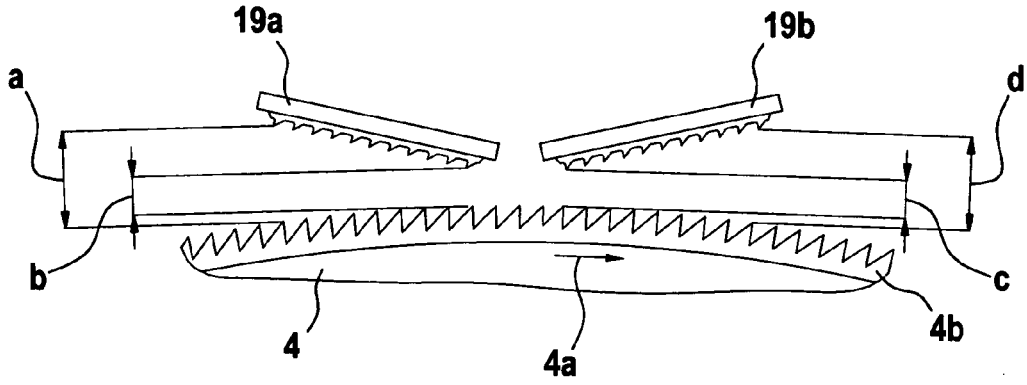
FIG. 4 shows spacings between the clothings of two carding elements and the cylinder clothing.

In the embodiment of FIG. 4, the clothing 20*a* of the carding element 19*a* forms an acute angle α with the tangent at the cylinder clothing 4*b* (cf. FIG. 2), as a result of which the carding nip becomes narrower in the direction of rotation 4*a* of the cylinder 4. The angle of inclination α is designated the so-called "offset angle". The spacing between the clothing 20*a* and the cylinder clothing 4*b* is denoted by reference letter a at the entrance to the carding nip and by reference letter b at the exit from the carding nip, a being greater than b. The clothing 20*b* of the carding element 19*b* forms an acute angle β with the tangent at the cylinder clothing 4*b* (cf. FIG. 2), as a result of which the carding nip opens out in the direction of rotation 4*a* of the cylinder 4. The angle of inclination β is designated the so-called "counter-offset angle". The angles α and β may be, for example, about 1°. The spacing between the clothing 20*b* and the cylinder clothing 4*b* is denoted by reference letter c at the entrance to the carding nip and by reference letter d at the exit from the carding nip, c being less than d. The spacings b and c, that is to say at the narrowest positions of the carding nip, are preferably the same or substantially the same, for example 3/1000".

Figure 5:
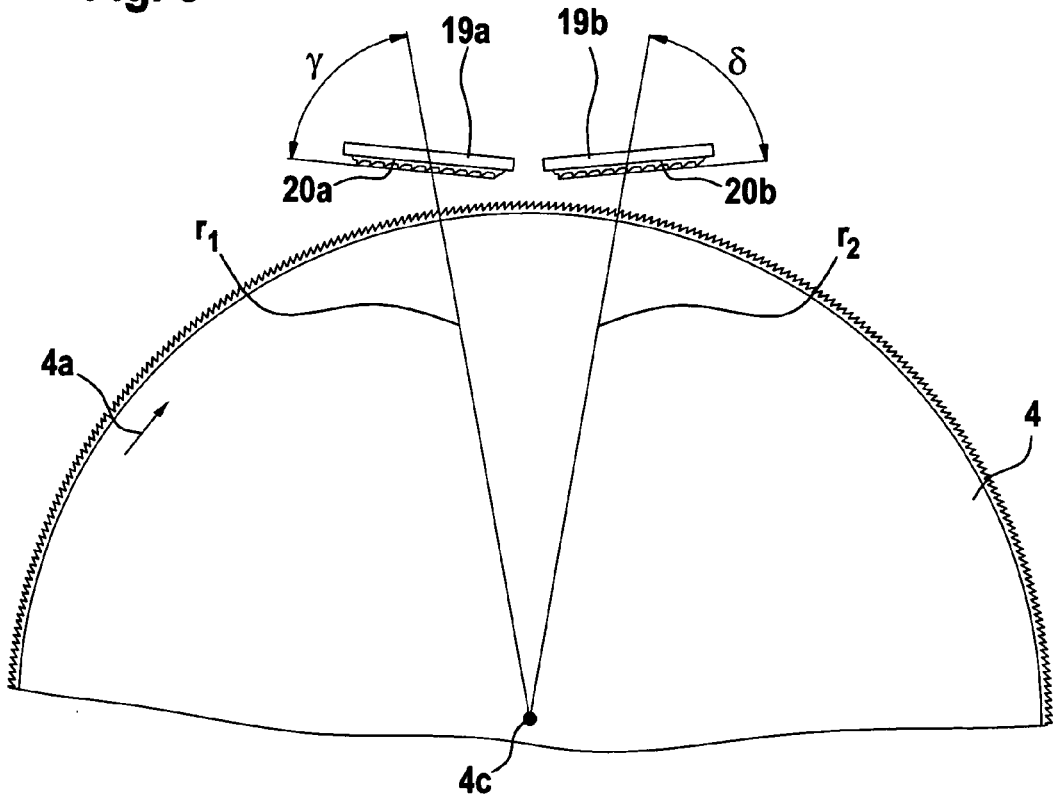
FIG. 5 shows two carding elements, the carding surfaces of which form an angle with a respective radius of the cylinder.

As FIG. 5 shows, the carding surface 20*a* of the carding element 19*a* forms an acute angle γ with a radius $r_1$ of the cylinder 4, and the carding surface 20*b* of the carding element 19*b* forms an acute angle δ with a radius $r_2$ of the cylinder 4.

Figure 6:
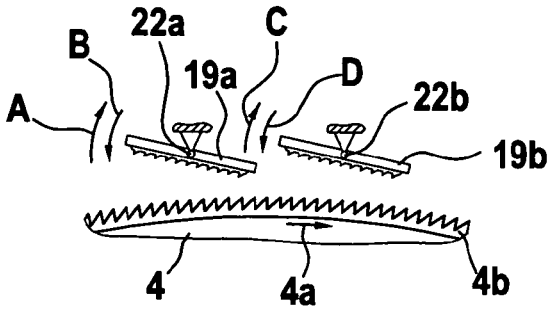
FIG. 6 shows two carding elements, which are rotatable about axes parallel to the cylinder axis.

In the embodiment of FIG. 6, the carding elements 19*a*, 19*b* are arranged to rotate at a rotary connection about a respective axis of rotation 22*a* and 22*b*, which is oriented parallel to the roller axis 4*c* (see FIG. 1). The axes of rotation 22*a*, 22*b* are located in a radial direction in relation to the cylinder 4, in the middle of the respective carding element 19*a* and 19*b*. As a result, the angles α, β (see FIG. 2) between the clothings 20*a*, 20*b* of the carding elements 19*a*, 19*b* and the cylinder clothing 4*b* are adjustable individually (that is to say, independently of one another) and by simple means. When there is a change in the angles α, β, the spacings b and c (see FIG. 4) preferably do not change. The carding elements 19*a*, 19*b* are stationary and arranged in movable manner in the carding segment 17*a*. "Stationary" means that the carding elements 19*a*, 19*b* maintain their position as such in the carding segment 17*a* and also with respect to the cylinder 4 without change. "Movable" means that the carding elements 19*a*, 19*b* are, for example, rotatable, by means of which the described angles of inclination α, β and spacings can be changed.

Figure 7:
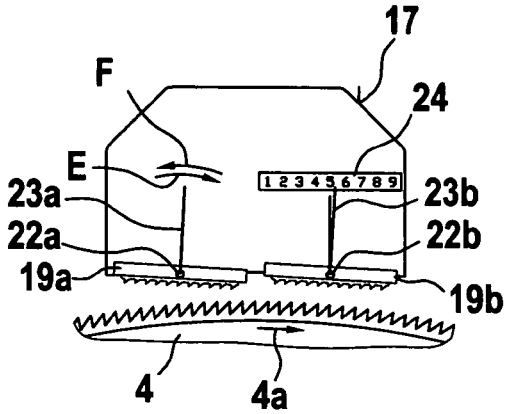
FIG. 7 shows two manually rotatable carding elements together with a display device.

In the embodiment of FIG. 7, one end of a lever 23*a*, 23*b* acts on a respective point of rotation 22*a* and 22*b* of the carding elements 19*a*, 19*b*. At the start, the lever 23*b* is in position no. 5 on the display device 24 (zero position). Associated with the lever 23*a* is a further display device (not shown). The starting position corresponds to an angle α=0° and β=0°. Moving the levers 23*a*, 23*b* in the direction of arrows E, F causes the associated carding element 19*a* and 19*b*, respectively, to rotate about the respective point of rotation 22*a* and 22*b*. The positions of the levers 23*a*, 23*b* can be fixed by means of a latching device (not shown) or the like.

Figure 8:
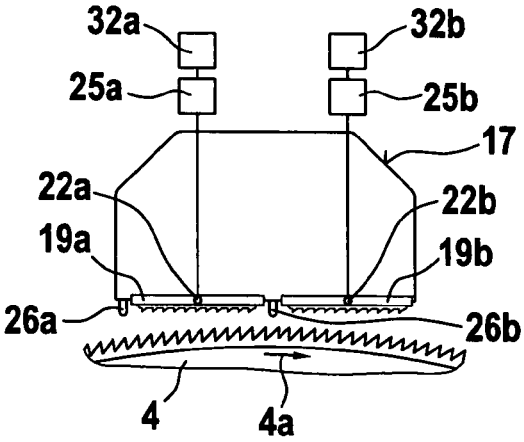
FIG. 8 shows two motor-rotatable carding elements, each having a deflection element.

In the embodiment of FIG. 8, adjustable drive motors 25*a* and 25*b*, for example step motors, act on the rotary connections 22*a*, 22*b* and set the angles of inclination α, β of the carding elements 19*a*, 19*b* in the manner shown in FIG. 7. At the intake into the carding elements 19*a*, 19*b* there is arranged, upstream of the clothings 20*a*, 20*b* of the carding elements 19*a* and 19*b*, respectively, seen in the direction of rotation 4*a* of the cylinder 4, a respective deflecting element 26*a* and 26*b* (spoiler). The deflecting element 26*a*, 26*b* may be longer than, as long as or shorter than the tips of the clothings 20*a*, 20*b*.

Figure 9:
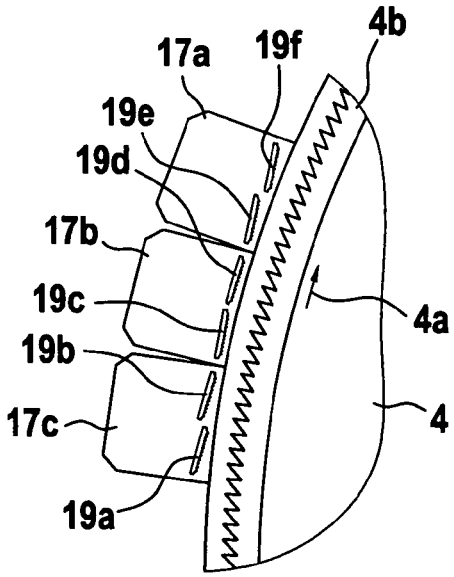
FIG. 9 shows three carding segments, each comprising two carding elements exhibiting—seen in the direction of rotation of the cylinder—an offset angle, no offset angle and a counter-offset angle.

In the embodiment of FIG. 9, three fixed carding segments 17*a*, 17*b* and 17*c* are provided opposite the clothing 4*b* of the cylinder 4 (cf. FIG. 3*a* in that regard). The fixed carding segments 17*a* to 17*c* each comprise two carding elements 19*a*, 19*b* and 19*c*, 19*d* and 19*e*, 19*f*, respectively. Seen in the direction of rotation 4*a* of the cylinder 4, the carding elements 19*a*, 19*b* arranged at the fibre intake exhibit an offset angle, the carding elements 19*c*, 19*d* arranged in the central region exhibit no offset angle, and the carding elements 19*e*, 19*f* arranged at the fibre exit exhibit a counter-offset angle, by means of which optimum carding action is brought about, together with a considerable reduction in wear on the carding clothings 20.

Figure 10:
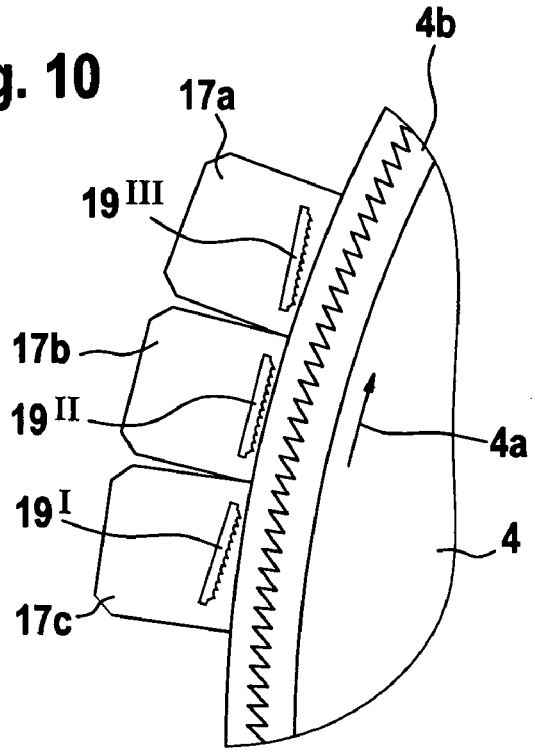
FIG. 10 shows three carding segments, each comprising one non-movable carding element.
Figure 11:
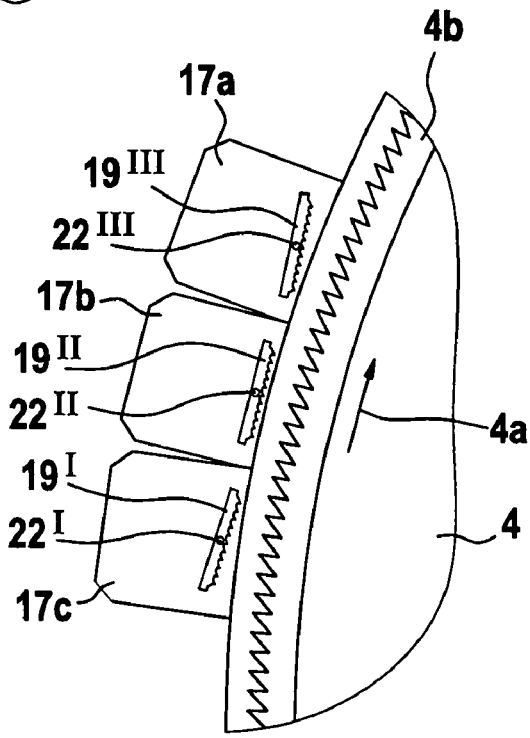
FIG. 11 shows three carding segments, each comprising one rotatable carding element.

FIGS. 10 and 11 show two arrangements, wherein one carding element 19', 19" and 19'" is associated with each of the fixed carding segments 17*a*, 17*b* and 17*c*, respectively. In accordance with FIG. 10, the carding elements 19', 19", 19'" are stationary and arranged in non-movable manner. The carding element 19' forms an offset angle, the carding element 19" forms no offset angle, and the carding element 19'" forms a counter-offset angle. In accordance with FIG. 11, the carding elements 19', 19", 19'" are mounted so as to be rotatable about a respective axis of rotation 22', 22" and 22'". All three carding elements 19', 19" and 19'" form an offset angle, the respective carding nips and angles of rotation becoming smaller in the direction of rotation 4*a* of the cylinder 4.

Figure 12:
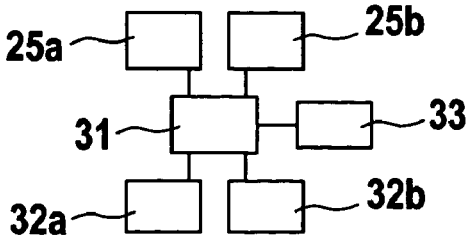
FIG. 12 is a generalised circuit diagram having an electronic control and regulation device together with two motor-driven actuating members for rotation of the carding elements, two angle-measuring devices and a display device.

In accordance with FIG. 12, the step motors 25*a*, 25*b* (FIG. 8), two angle-measuring devices 32*a*, 32*b* and a display device 33, for example a display monitor or the like, are connected to an electronic control and regulation device 31, for example a microcomputer machine control, by means of which the angles of inclination α β of the carding elements 19*a*, 19*b* can be adjusted either manually by means of an input device (not shown) or automatically by means of a memory (not shown).

Although the foregoing invention has been described in detail by way of illustration and example for purposes of clarity and understanding, it will be obvious that changes and modifications may be practised within the scope of the appended claims.

What is claimed is:

1. A carding machine having:

a roller which has a direction of rotation;

a carding segment opposing said roller and comprising a carrier and first and second carding elements arranged one behind the other in the direction of rotation of the roller;

wherein:

said first carding element has a first carding surface;

said second carding element has a second carding surface;

said carding segment, exclusive of said carding elements, is immovable; and at least one of said carding surfaces is inclined with respect to a tangent at the opposed roller surface.

2. A carding machine according to claim 1, in which the carding elements are arranged in stationary manner.

3. A carding machine according to claim 1, in which said roller is the carding cylinder of the carding machine.

4. A carding machine according to claim 1, in which the carding elements are non-movable.

5. A carding machine according to claim 1, in which the carding elements are movable.

6. A carding machine according to claim 1, in which the first and second carding elements are arranged to be individually movable in the carrier.

7. A carding machine according to claim 6, in which an adjusting device for the rotation is provided.

8. A carding machine according to claim 6, in which each carding element is arranged to be rotatable in the carrier with two degrees of freedom.

9. A carding machine according to claim 1, in which the carding elements are each rotatable about an axis parallel to the roller.

10. A carding machine according to claim 1, in which said first and second elements are each inclined relative to respective tangents at the opposed roller surface, the angle of inclination being substantially the same.

11. A carding machine according to claim 10, in which the or each angle of inclination is acute.

12. A carding machine according to claim 1, in which said first and second elements are each inclined to respective tangents at the opposed roller surface, the angles of inclination being different.

13. A carding machine according to claim 1, in which said first and second elements are each inclined relative to respective tangents at the opposed roller surface, at least one of the elements having an angle of inclination that is obtuse.

14. A carding machine according to claim 1, in which an angle of inclination can be changed in operation and out of operation of the carding machine.

15. A carding machine according to claim 1, in which the angle of inclination for two carding elements can be changed simultaneously, the angular position settings of the carding elements being coupled to one another.

16. A carding machine according to claim 15, in which, when the angles are changed, the transmission ratio (angular change) of each carding element is different.

17. A carding machine according to claim 15, comprising a central adjusting device for changing the angles of all the carding elements.

18. A carding machine according to claim 1, in which the angle of inclination is arranged to be changeable starting from a tangential position of the carding surface of the carding element (zero point).

19. A carding machine according to claim 1, in which the carding nip becomes smaller at the first carding element and larger at the second carding element, seen in the direction of rotation of the cylinder.

20. A carding machine according to claim 1, in which the first and second elements form with the roller first and second carding nips, the spacings at the narrowest locations of each of the first and second carding nips being the same or substantially the same.

21. A carding machine according to claim 1, in which two or more said carding elements are arranged to be adjusted in stepped manner from carding segment to carding segment, for example to be changed centrally by 0.5°.

22. A carding machine according to claim 1, in which the position of the carding elements can be detected.

23. A carding machine according to claim 1, in which at least one device comprising a said carding segment is arranged in one or more zones selected from the preliminary carding zone between a licker-in and the rear card-top-deflecting roller of the revolving card top, the after-carding zone between a doffer and a front card-top-deflecting roller of the revolving card top, and an underneath carding zone on said carding cylinder between a doffer and a licker-in of said carding machine.

24. A carding machine according to claim 23, comprising two or more said carding segments.

25. A carding machine according to claim 1, in which the roller is a cylinder and only stationary card top elements are associated with the cylinder of the carding machine, a plurality of said carding segments being provided at the cylinder.

26. A carding machine wherein at least one stationary carding element segment comprising a carrier and a carding element is associated with a roller, for example a cylinder, and wherein the clothing of the carding element and the roller clothing are located opposite one another, wherein the carding surface of the carding element forms an angle to a tangent at the clothing of the roller, the carding element is arranged in stationary manner with respect to the roller, and said carding segment, exclusive of said carding elements, is immovable.

27. A carding machine according to claim 26, in which a plurality of carding segments are arranged behind one another in the work direction.

28. A carding machine having a roller which has a direction of rotation, and a carding segment, the carding segment having a carrier and at least first and second carding elements which are arranged one behind the other in the direction of rotation of the roller and in opposing relationship to the roller, wherein said first and second carding elements each have a carding surface, at least one of said carding surfaces is inclined with respect to a tangent at the opposed roller surface, said first and second carding elements are arranged to be stationary relative to the roller in operation, and said carding segment, exclusive of said carding elements, is immovable.

29. Apparatus at a carding machine, wherein at least one stationary carding segment comprising a carrier together with at least two carding elements is associated with a roller, for example a cylinder, which carding elements are arranged behind one another in the direction of rotation of the roller, and wherein the clothings of the carding elements and the roller clothing are located opposite one another, wherein the carding surface of at least one carding element forms an angle with a respective tangent at the clothing of the roller, the carding elements are arranged in stationary manner with respect to the roller, and said carding segment, exclusive of said carding elements, is immovable.

* * * * *